United States Patent [19]

Kates

[11] 4,129,624

[45] Dec. 12, 1978

[54] FLUID MIXER

[75] Inventor: Willard A. Kates, Winnetka, Ill.

[73] Assignee: The W. A. Kates Company, Deerfield, Ill.

[21] Appl. No.: 796,844

[22] Filed: May 13, 1977

[51] Int. Cl.[2] ..... B01F 15/02

[52] U.S. Cl. ..... 261/76; 261/79 A; 366/340

[58] Field of Search ..... 261/76, 79 A, 78 A, 261/DIG. 75; 366/336, 340, 337, 160, 162

[56] References Cited

U.S. PATENT DOCUMENTS

| | | | |
|---|---|---|---|
| 3,402,916 | 9/1968 | Kates | 366/167 |
| 3,430,865 | 3/1969 | McDougall | 261/DIG. 26 |
| 3,749,378 | 7/1973 | Rhodes | 261/DIG. 75 |
| 3,801,073 | 4/1974 | Kates | 366/151 |
| 3,840,216 | 10/1974 | Smith et al. | 261/DIG. 75 |
| 3,910,838 | 10/1975 | Kaelin | 261/77 |

*Primary Examiner*—Frank W. Lutter
*Assistant Examiner*—Gregory N. Clements
*Attorney, Agent, or Firm*—Wegner, Stellman, McCord, Wiles & Wood

[57] ABSTRACT

A fluid mixer providing improved fine mixing of a rough mixture of liquid and gas. The mixer includes a plurality of grooved annular plates defining an annular array of flow passages leading inwardly from a delivery space receiving the rough mixture to an inner central outlet space for discharging the fine mixture. The gas is introduced into the liquid to define the rough mixture in the form of an annular stream directed toward an inlet opening delivering the liquid to a mixing space. The rough mixture is delivered through a transfer space to the annular space about the fine mixer. The annular inlet space has a relatively large volume to provide a low flow rate therethrough to the fine mixer. Confronting grooves of the fine mixer plates may cross, and in the illustrated embodiment, the grooves of one face cross a plurality of grooves of the opposite face. The grooved plates may be arranged in aligned relationship or may be randomly disposed as desired.

28 Claims, 5 Drawing Figures

FLUID MIXER

BACKGROUND OF THE INVENTION

1. Field of the Invention

This invention relates to fluid mixers and in particular to mixers for fine mixing of gas and liquid fluids.

2. Description of the Prior Art

In applicant's prior U.S. Pat. No. 3,801,073, a fluid mixer is shown wherein a plurality of fluid jets are delivered to a chamber in angled relationship to each other for turbulent mixing therein. The jets are produced by a plurality of grooved annular elements wherein the grooves are chordal and arranged at opposite angles at different positions spaced axially of the mixer. The grooved annular elements are spaced by flat annular elements so as to provide a desired radially outward discharge of the mixed fluid into an outer annular space for subsequent delivery therefrom.

Another improved fluid mixing device is shown in applicant's earlier prior U.S. Pat. No. 3,402,916 wherein the mixing device comprised a passage surrounded by a chamber with the passage being provided with a first and second plurality of ports inclined relative to the radius of the passage and oriented in opposite directions so as to provide intense turbulence at the shear planes thus created. The outer chamber was provided with an exit for the thusly mixed fluids.

In the copending U.S. patent application, Ser. No. 708,708, of applicant, entitled "Readily Disassembleable Fluid Flow Rate Controller", a fluid flow rate controller is disclosed having readily separable housing portions permitting facilitated maintenance of the device whereby the device is advantageously adapted for use with food products, such as dairy food products.

SUMMARY OF THE INVENTION

The present invention comprehends an improved fluid mixer for providing a highly accurate, fine mixture of a gas and a liquid.

In the illustrated embodiment, the fluid mixer is utilized with a flow rate controller generally similar to that of the above described flow rate controller. In the present invention, the liquid delivered from the flow rate controller is mixed with a gas, such as air, to define a rough mixture in a first portion of the fluid mixer and the rough mixture is then further mixed in a second portion of the mixer to define the desired fine mixture which is delivered to a suitable discharge as desired.

The fluid mixer of the present invention defines means for injecting into a liquid a fine stream of gas to provide a rough mixture, means for conducting the liquid-gas rough mixture to an annular inlet space, and means defining an annular space to a central outlet space for causing the rough mixture flowed through the flow passages to be further mixed therein to define a fine mixture of the liquid and gas for delivery from the outlet space.

More specifically, the fluid mixer defines means forming an annular space bounded by an inner annular wall and an outer annular wall, passage means in the inner wall for delivering a liquid outwardly therethrough to a preselected portion of the annular space, gas supply means directed toward the passage means for delivering a gas in an annular stream inwardly through the outer wall into the incoming liquid to form a rough gas-liquid mixture throughout the annular space, and means defining a transfer space opening axially to the annular space for transferring the rough mixture from throughout all the annular space.

Further more specifically, the means for forming the rough mixture into a fine mixture include a plurality of annular plates defining confronting surfaces having chordal grooves, the grooves of one of the confronting surfaces crossing the grooves of the other confronting surface to cause fine mixing of the rough mixture as a result of the flow of the rough mixture inwardly concurrently through the grooves. In the illustrated embodiment, the gas supply means comprises a tubular housing, a coaxial inner plug defining with the housing a circumferential tubular gas flow space opening at one end to the annular space, and means for supplying pressurized gas to the other end of the tubular space for flow therethrough outwardly through the one end into the incoming liquid from the passage means.

In the illustrated embodiment, the flow rate controller may be provided with a plurality of openings to the rough mixing space with the air supply means being aligned with a single one of the openings.

The annular space surrounding the fine mixer is preferably relatively large in volume so as to provide a low rate of flow therethrough.

In the illustrated embodiment, each of the fine mixer annular plates defines a central opening and opposite annular grooved faces, the grooves of one face extending chordally outwardly from the opening and the grooves of the opposite face extending oppositely outwardly from the opening in aligned relationship with the grooves of the one face.

In the illustrated embodiment, the grooves of one of the plate surfaces crosses a plurality of grooves of the confronting plate surface, and more specifically in the illustrated embodiment, the grooves of one surface crosses three grooves of the confronting surface.

The fluid mixer is provided in a housing adapted to be readily removably secured to the housing of the flow rate controller for facilitated sanitizing maintenance thereof as desired.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
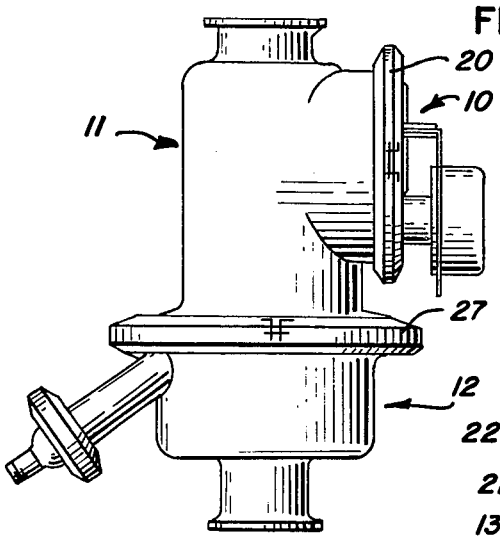
FIG. 1 is a side elevation of a flow regulated fluid mixer embodying the invention.

In the exemplary embodiment of the invention as disclosed in the drawing, a flow regulated mixer generally designated 10 is shown to include a flow rate controller portion generally designated 11 and a fluid mixer portion generally designated 12. In the illustrated embodiment, the apparatus 10 is disclosed with reference to its use with a food product, such as an ice cream mix, it being understood that the apparatus may be utilized with any suitable liquid and gas components.

Briefly, the flow rate controller 11 defines a housing 13 having an inlet 14 and a plurality of outlet openings 15. In the illustrated embodiment, the inlet opening 14 is at one end of the housing and the outlet openings 15 open radially outwardly through the opposite closed end 16 of the housing.

A flow rate control device generally designated 17 is carried on a removable wall portion 18 of the housing 13. Wall 18 may be secured to a suitable annular flange 19 of the housing 13 by a clamp band 20 providing facilitated sealed assembly and disassembly of wall 18 relative to housing 13, as desired.

The flow regulator further includes a piston 21 axially movable in a cylinder 22. The piston is biased upwardly against the fluid pressure at the inlet 14 by a suitable coil spring 23. The lower edge 24 of the piston adjustably closes the outlet openings 15 so as to effectively provide a maintained desired rate of flow of the supply liquid over a wide range of pressure thereof.

The present invention is concerned with the forming of a fine mixture of the liquid delivered through the regulator 11, with a gas, such as air.

Figure 2:
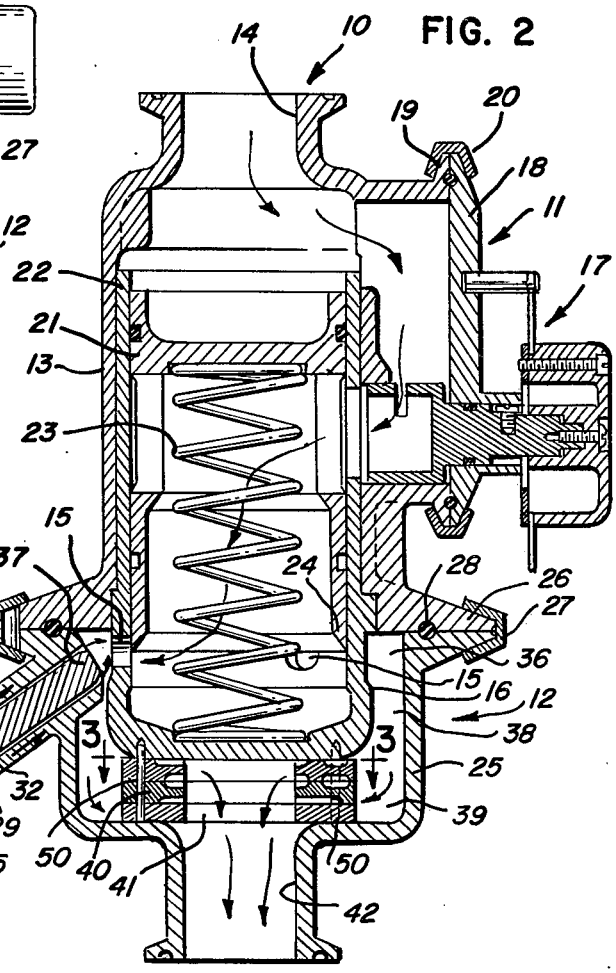
FIG. 2 is a vertical diametric section thereof.
Figure 3:
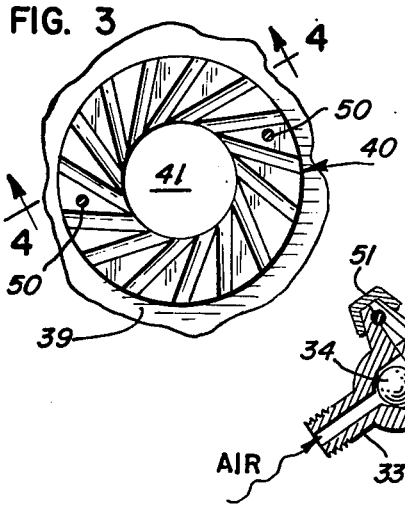
FIG. 3 is a horizontal section taken substantially along the line 3—3 of FIG. 2.

More specifically, as shown in FIG. 2 of the drawing, the mixing device 12 is defined by a housing 25 removably sealingly secured to the lower end 26 of regulator housing 13 by a suitable clamp band 27. As shown, a suitable O-ring 28 may be utilized to effect the desired sealed connection between the housing 25 and housing portion 26.

Air is introduced into the liquid delivered from the regulator through one of the openings 15 by means of an air injector generally designated 29. The air injector defines a tubular housing 30 having an inner cylindrical plug 31 coaxially centered within the housing to define therebetween a thin tubular clearance space 32. Pressurized air is delivered to the clearance space 32 from an inlet connection 33 adapted to be connected to a suitable source of pressurized air. The connector 33 may be provided with a check ball valve 34. Air flows from the connector 33 into an annular inlet space 35 at the outer end of the clearance space 32 and thence through the clearance space into an annular mixing space 36 within the mixer housing 25 surrounding the lower cylinder portion 16 defining the openings 15.

As shown in FIG. 2, the inner end 37 of the plug 31 is tapered toward one of the openings 15. Thus, the air delivered from the clearance space 32 is directed at the center of the aligned opening 15 to provide an improved initial rough mixture of the air with the incoming liquid from the regulator portion 11 of the apparatus 10. It has been found that a single such air delivery means provides a suitable rough mixture of the entire quantity of liquid notwithstanding delivery of additional portions of the liquid from the regulator through the other openings 15.

The thusly formed rough mixture of liquid and air is delivered through a tubular transfer space 38 to the lower portion 39 of the mixer housing 25 in which is carried a fine mixing device generally designated 40. The rough mixture is caused to pass through the fine mixing device into a central outlet 41 thereof for subsequent delivery through an outlet portion 42 of the housing 25 as desired.

Figure 4:
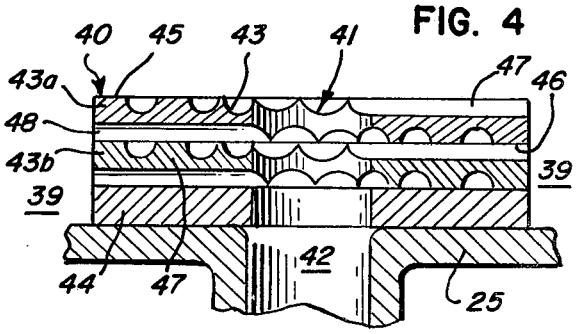
FIG. 4 is a fragmentary enlarged vertical section taken substantially along the line 4—4 of FIG. 3.

As best seen in FIG. 4, the fine mixer comprises a plurality of grooved mixing plates 43 disposed in stacked relationship one on the other. In the illustrated embodiment, the mixing plates are spaced from the housing wall 25 by a suitable annular spacer 44.

Figure 5:
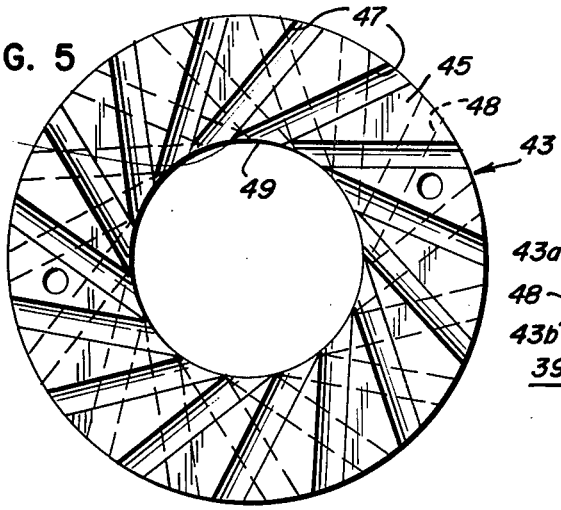
FIG. 5 is a plan view of a mixer plate showing the grooves of the underside surface thereof in dotted lines.

Each of the mixing plates is defined by a front surface 45 and a rear surface 46. Front surface 45, as shown in FIG. 5, is provided with a plurality of chordal, forwardly opening rectilinear grooves 47. The grooves extend at a preselected angle outwardly from a central opening 48 of the plates cooperatively defining the central space 41 of the mixing device 40. As shown in FIG. 5, the grooves 47 may extend in a clockwise direction when viewing the front face 45.

The rear face 46 of the mixing plate 43 is provided with a plurality of chordal rectilinear grooves 48 as shown in dotted lines in FIG. 5. Grooves 48 extend angularly from the central opening 49 of the plate in a counterclockwise direction when looking at the front face 45 of the disc, as shown in FIG. 5. If desired, the stack of mixing plates and spacer plates may be retained in a preselected angular relationship to each other by suitable dowel pins 50, as shown in FIG. 2. In the preselected relationship of the illustrated embodiment, the plates are aligned so that the grooves 47 of each of the plates are axially aligned and the grooves 48 of each of the plates are axially aligned. Thus, the grooves 48 of the rear face 46 of the upper mixing plate 43*a* shown in FIG. 4 cross the grooves 47 of the front face of the subjacent mixing plate 43*b*. The crossing is effectively similar to the crossing relationship of the grooves 47 and 48 illustrated in FIG. 5, and thus, the grooves of one confronting face of the mixing plates cross three grooves of the face of the adjacent mixing disc confronting the same. The uppermost and lowermost grooves face planar surfaces and, thus, straight-through flow is effected therethrough while the crossing relationship of the intermediate confronting grooves in the stack provides a highly turbulent final mixing of the air and liquid flowing therethrough to the inner space 41.

As will be obvious to those skilled in the art, the amount of mixing may be controlled by suitably controlling the supply of air to the liquid in forming the initial rough mixture, and by suitably preselecting the number and size of the mixing grooves of the mixing plates for forming the final fine mixture.

The volume of the annular space 39 surrounding the fine mixer 40 is preferably relatively large so that channeling of the rough mixture to the grooves is effectively avoided. The number of mixer plates utilized in the mixer 40 may be varied as desired.

As the housing 25 may be readily removed from the regulator housing 13 by simple removal of the clamp band 27, the mixer is readily sanitarily maintained. As shown, the connector 33 is connected to the air supply housing 30 by a similar clamp band 51 permitting the air supply means 29 to be readily disassembled for sanitary maintenance.

Upon removal of the housing 25 from the regulator housing 13, the mixing plates 43 may be readily removed from the dowel pins 50 by simple sliding movement downwardly therefrom. Similarly, replacement of the mixing plates is readily reversibly effected. As will be obvious to those skilled in the art, substitution of differently grooved plates and different numbers of plates may be readily effected so as to conform the action of the mixer to the liquid and gas components to be finely mixed therein.

In one use of the improved apparatus 10, an accurate control of the fine mixture gas and liquid components was obtained far exceeding the control provided by the conventional mixers heretofore used in this art. Thus, the apparatus 10 is advantageously adaptable for use in food processing where accurate control over the component ratios must be effected. Further, because of the facilitated sanitary maintenance permissible with the apparatus 10, further improved advantageous use in such food processing is provided.

The foregoing disclosure of specific embodiments is illustrative of the broad inventive concepts comprehended by the invention.

I claim:

1. A fluid mixer comprising:

means for injecting into a liquid a fine stream of gas to provide a rough mixture;

means for conducting the liquid-gas rough mixture to an annular inlet space; and means defining a first annular array of chordal substantially rectilinear flow passages leading inwardly from said inlet space to a central outlet space, and a second annular array of chordal substantially rectilinear flow passages intersecting said first flow passages for causing the rough mixture flowed through said flow passages to be discharged into said central outlet space in intersecting streams whereby the rough mixture is further mixed therein to define a fine mixture of said liquid and gas for delivery from said outlet space.

2. The fluid mixer of claim 1 wherein said annular array comprises a plurality of sets of said intersecting flow passages, said sets being spaced apart axially.

3. The fluid mixer of claim 1 wherein said annular inlet space has a large radial dimension.

4. The fluid mixer of claim 1 wherein said each flow passage of either array intersects a plurality of flow passages of the other array.

5. The fluid mixer of claim 1 wherein said first and second arrays are defined by a pair of annular plates having confronting faces provided with axially open grooves, said confronting faces of the pair being in facial abutment.

6. The fluid mixer of claim 1 wherein said means for injecting gas into the liquid comprises means for delivering the gas into the liquid in the form of an annular stream.

7. A fluid mixer comprising:

means defining an annular space bounded by an inner annular wall and an outer annular wall;

passage means in said inner wall for delivering a liquid outwardly therethrough to a preselected portion of said annular space;

gas supply means directed toward said passage means and defining an annular passage concentric to a central core element for delivering a gas in an annular stream from said annular passage inwardly through said outer wall into the incoming liquid to form a rough gas-liquid mixture throughout said annular space.

8. The fluid mixer of claim 7 wherein said gas supply means includes a check valve for permitting only unilateral fluid flow inwardly therethrough.

9. The fluid mixer of claim 7 wherein said gas supply means includes an outer tubular housing formed unitarily with said means defining said annular space.

10. The fluid mixer of claim 7 wherein said passage means opens to said annular space perpendicularly to the axis of said space and said gas supply means stream is directed angularly toward said passage means.

11. The fluid mixer of claim 7 wherein said passage means opens to said annular space perpendicularly to the axis of said space and said gas supply means stream is directed angularly toward said passage means with the axis of said stream being in an axial plane of said annular space.

12. The fluid mixer of claim 7 wherein said passage means comprises means defining a plurality of circumferentially spaced openings in said inner annular wall.

13. The fluid mixer of claim 7 wherein said passage means comprises means defining a plurality of circumferentially spaced openings in said inner annular wall, said gas supply means comprising means providing a single annular gas stream to said annular space.

14. The fluid mixeer of claim 7 further including means in said annular space defining an annular array of flow passages leading radially inwardly from a radially outer portion of said annular space to a central outlet space for causing the rough mixture to be flowed through said flow passages and thereby further mixed therein to define a fine mixture of said liquid and gas for delivery from said outlet space, said means defining the annular array including a plurality of annular plates defining confronting surfaces having chordal grooves, the grooves of one of the confronting surfaces effectively intersecting the grooves of the other confronting surface to cause the fine mixing of the rough mixture as a result of the flow of the rough mixture inwardly concurrently through said grooves.

15. The fluid mixer of claim 14 wherein the grooves of one face extend chordally outwardly from said opening at a clockwise angle to the axis of the plate looking toward said one face and the grooves of the opposite face extend chordally outwardly from said opening at a clockwise angle to the axis of the plate looking toward said opposite face, the grooves of said one surface crossing a plurality of grooves of the confronting surface.

16. A fluid mixer comprising:

means defining an annular space bounded by an inner annular wall and an outer annular wall;

passage means in said inner wall for delivering a liquid outwardly therethrough to a preselected portion of said annular space;

gas supply means directed toward said passage means for delivering a gas in an annular stream inwardly through said outer wall into the incoming liquid to form a rough gas-liquid mixture throughout said annular space, said gas supply means comprising a tubular housing, a coaxial inner plug defining with said housing a circumferential tubular gas flow space opening at one end to said annular space, and means for supplying pressurized gas to the other end of said tubular space for flow therethrough outwardly through said one end into the incoming liquid from said passage means.

17. The fluid mixer of claim 11 wherein said plug is provided with a tapered end at said one end of the tubular space, said taper being axially aligned with the center of said passage means.

18. The fluid mixer of claim 16 wherein said plug is provided with a tapered end at said one end of the tubular space, said taper being axially aligned with the center of said passage means at the opening thereof to said annular space.

19. The fluid mixer of claim 16 wherein said plug is provided with a tapered end at said one end of the tubular space, said taper being axially aligned with the center of said passage means aligned with a single one of said openings.

20. A fluid mixer comprising:

means defining an annular space;

means providing a rough mixture of gas and liquid; and means for forming said rough mixture into a fine mixture of said gas and liquid including a plurality of coaxially stacked annular plates defining confronting surfaces having chordal grooves, the grooves of one of the confronting surfaces intersecting the grooves of the other confronting surface to cause fine mixing of the rough mixture as a result of the intersecting flow of the rough mixture in said grooves.

21. The fluid mixer of claim 20 wherein each of said plates defines a central opening and opposite annular grooved faces, the grooves of one face extending chordally outwardly from said opening and the grooves of the opposite face extending oppositely outwardly from said opening in aligned relationship with the grooves of said one face.

22. The fluid mixer of claim 20 wherein each of said plates defines a central opening and opposite grooved faces, the grooves of one face extending chordally outwardly from said opening at a clockwise angle to the axis of the plate looking toward said one face, and the grooves of the opposite face extending chordally outwardly from said opening at a clockwise angle to the axis of the plate looking toward said opposite face.

23. The fluid mixer of claim 20 wherein said grooves of said one surface cross a plurality of grooves of the confronting surface.

24. The fluid mixer of claim 20 wherein said grooves of said one surface cross at least three grooves of the confronting surface.

25. The fluid mixer of claim 20 further including indexing means for causing a preselected rotational disposition of the plates relative to each other.

26. The fluid mixer of claim 20 wherein each of said plates defines opposite flat faces each provided with chordal grooves.

27. The fluid mixer of claim 20 wherein the grooves of each plate are arranged similarly to the grooves of the other plates.

28. The fluid mixer of claim 20 wherein the grooves of each plate are arranged similarly to the grooves of the other plates, the grooves of each plate being aligned with the grooves of the other plates in the direction of the axis of the coaxially stacked plates.

* * * * *